US008888349B1

(12) United States Patent
Tessnow et al.

(10) Patent No.: US 8,888,349 B1
(45) Date of Patent: Nov. 18, 2014

(54) LED LAMP WITH CONCAVE REFLECTOR FOR POSTER DISPLAY CASE

(71) Applicants: Thomas Tessnow, Weare, NH (US); Kim Albright, Warner, NH (US); Ronald E. Boyd, Jr., Chichester, NH (US)

(72) Inventors: Thomas Tessnow, Weare, NH (US); Kim Albright, Warner, NH (US); Ronald E. Boyd, Jr., Chichester, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/962,361

(22) Filed: Aug. 8, 2013

(51) Int. Cl.
*A47F 3/00* (2006.01)

(52) U.S. Cl.
CPC ..... *A47F 3/001* (2013.01)
USPC ..... 362/609; 362/125

(58) Field of Classification Search
USPC ..... 362/125, 600–609
See application file for complete search history.

(56) References Cited

U.S. PATENT DOCUMENTS

| | | | | |
|---|---|---|---|---|
| 5,079,675 | A | 1/1992 | Nakayama | |
| 6,296,376 | B1 | 10/2001 | Kondo et al. | |
| 7,134,774 | B2 | 11/2006 | Iwasaki | |
| 7,270,448 | B1 | 9/2007 | Maley, Sr. | |
| 7,618,157 | B1 | 11/2009 | Galvez et al. | |
| 7,841,733 | B2 | 11/2010 | Meulenbelt | |
| 8,425,101 | B2 * | 4/2013 | Boonekamp | 362/609 |
| 2006/0262554 | A1 * | 11/2006 | Mok et al. | 362/555 |
| 2010/0085748 | A1 * | 4/2010 | Kelly et al. | 362/235 |
| 2010/0172152 | A1 * | 7/2010 | Boonekamp | 362/609 |
| 2011/0019410 | A1 * | 1/2011 | Ibanez et al. | 362/235 |
| 2014/0198487 | A1 * | 7/2014 | Tessnow et al. | 362/126 |

* cited by examiner

*Primary Examiner* — Mary Ellen Bowman
(74) *Attorney, Agent, or Firm* — Edward S. Podszus

(57) ABSTRACT

A replacement lamp for a cinema poster display case. Light from a linear array of white-light LEDs reflects off a concave reflector to an illumination plane at or near a front face of the display case. The concave reflector intersects with surface normals from the LED emission faces along an intersection line. The concave reflector has proximal and distal portion on opposite sides of the intersection line. The illumination plane is disposed on an opposite side of the LEDs from the intersection line. The illumination plane has a proximal portion near the LEDs and a distal portion away from the LEDs. Light reflected from the LEDs off the proximal portion of the concave reflector is directed to the distal portion of the illumination plane. Light reflected from the LEDs off the distal portion of the concave reflector is directed to the proximal portion of the illumination plane.

15 Claims, 6 Drawing Sheets

LED LAMP WITH CONCAVE REFLECTOR FOR POSTER DISPLAY CASE

TECHNICAL FIELD

The present disclosure relates to cinema poster display cases.

BACKGROUND

Cinema poster display cases, sometimes referred to as display signs, have been in use for many years, and are typically sized to accommodate a standard-sized movie poster. In the U.S., the standard film poster commonly displayed in theaters is known as a "one sheet", which is 27 inches wide by 40 inches tall. Other countries have their own standard terminologies and sizes.

For a theatrical engagement of a particular movie, a poster arrives in the mail, rolled up in a tube from the respective film distributor. The poster is unrolled and placed in the front of a sign, which usually has a clamping mechanism to hold the poster against the front panel of the sign. At the end of the movie engagement, the poster is removed from the sign.

In a typical cinema sign, the movie poster is illuminated from the back and viewed from the front. These posters usually have a left-right inverted image of the front side printed on the back side, so that when viewed in back-lit illumination, the poster forms a single image with generally high contrast. Such posters may be referred to as "double sided".

Initially, these movie signs used incandescent lamps as their light sources. In recent years, the incandescent lamps have been replaced by fluorescent lamps. The standard "one sheet"-sized cinema sign has fluorescent tubes extending vertically along the left and right edges of the poster area of the sign. When displayed in the sign, the poster is disposed at the front panel of the sign, and is typically about five inches in front of the back surface of the sign.

In recent years, light-emitting-diodes (LEDs) have emerged as a new technology for illumination and lighting applications. LEDs have potential advantages over fluorescent lamps in that they may be more efficient, may produce less heat, may having longer lifetimes, and may function more efficiently at cold temperatures. For these reasons and others, there has been a recent effort to incorporate LEDs into cinema signs. For example, a known LED-based display device is discussed in U.S. Pat. No. 7,841,733 (Meulenbelt).

SUMMARY

An embodiment is a replacement lamp for a display case. The display case has an illumination plane at which viewable objects are placeable. The lamp includes a plurality of LEDs spaced along a line. Each LED has a surface normal and emits light into an angular distribution centered around the respective surface normal. The surface normals are all generally parallel. The lamp also includes an elongated concave reflector that reflects light emitted from the LEDs onto the illumination plane. The concave reflector intersects with the surface normals along an intersection line. The concave reflector extends from a proximal portion near the LEDs to a distal portion away from the LEDs. The proximal and distal portions are on opposite sides of the intersection line. The illumination plane is disposed on an opposite side of the LEDs from the intersection line. The illumination plane has a proximal portion near the LEDs and a distal portion away from the LEDs. Light reflected from the LEDs off the proximal portion of the concave reflector is directed to the distal portion of the illumination plane. Light reflected from the LEDs off the distal portion of the concave reflector is directed to the proximal portion of the illumination plane.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF PREFERRED EMBODIMENTS INCLUDING BEST MODE

Figure 1:
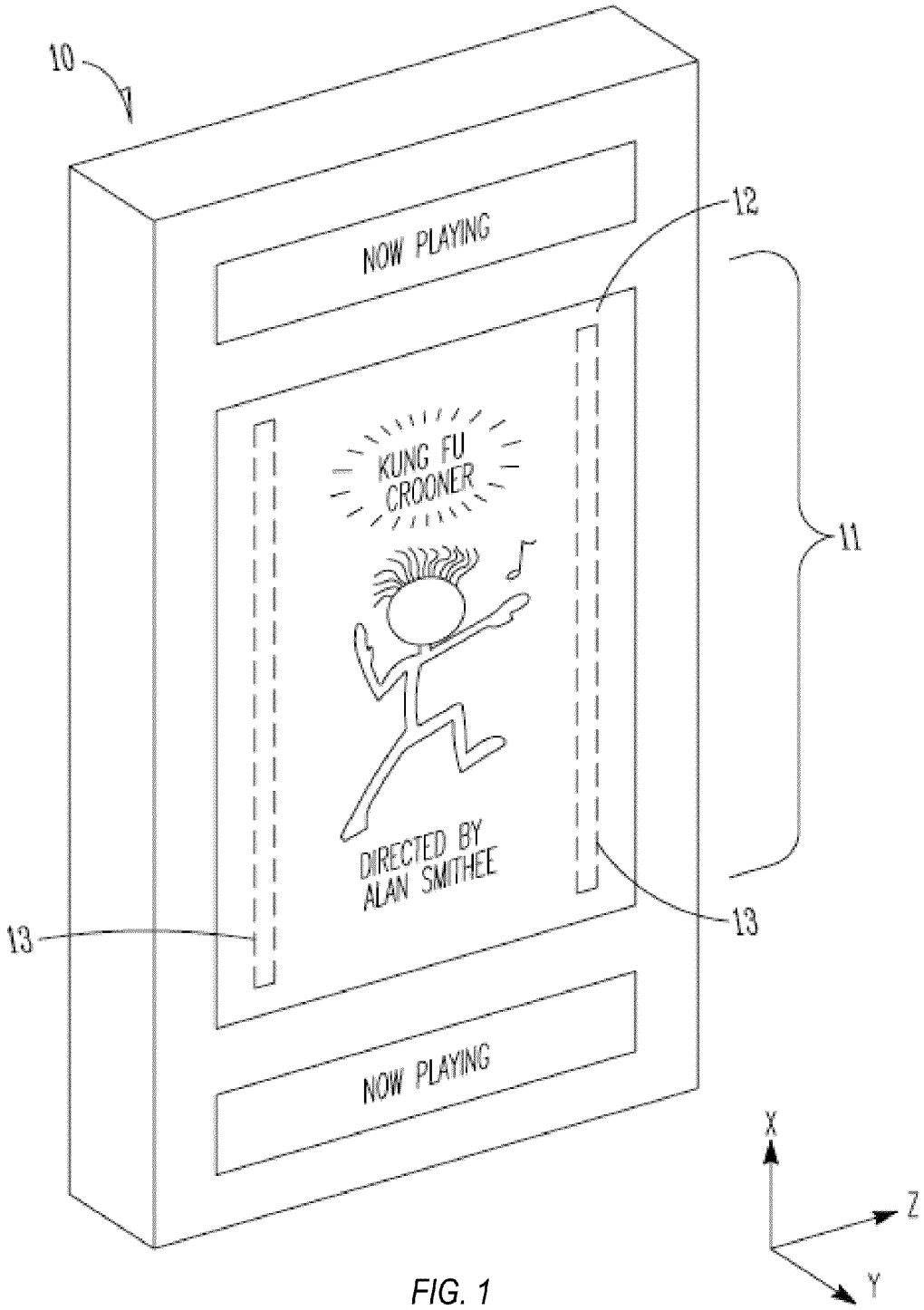
FIG. 1 PRIOR ART
FIG. 1 is a perspective drawing of a movie poster display case.

Because cinema poster display signs are typically mounted on the wall of a theater, and are generally a standard size, such as a "one sheet" in the U.S., it is beneficial to establish a convention for describing the various orientations and directions encountered in this document. The term "vertical" refers to the direction perpendicular to the ground, or "up". The terms "lateral" and "forward" are used in this document, where "lateral" denotes the "left"-to-"right" direction, which is parallel to the top edge of the sign and parallel to the ground, and "forward" denotes the direction perpendicular to the viewable face of the sign and parallel to the ground. In the drawings, the directions of vertical, forward and lateral are noted by the shorthand labels of X, Y and Z. It is understood that the terms lateral, forward and vertical describe orientations and directions not only when the sign is in use, but may also be used for convenience to describe the relative orientations of elements with respect to each other even when the sign is uninstalled, is inactive on a shelf or is in shipment.

Similarly, the term "generally" is used in this document to denote a typical direction, or a direction that is a combination of an intended direction with a slight misalignment caused by typical manufacturing, alignment or assembly tolerances.

A trend in many lighting or illumination applications is to use light emitting diodes (LEDs) as the light sources. Compared with most incandescent and fluorescent light sources, LEDs are more efficient, produce less heat, and have longer lifetimes. In particular, for cold-weather outdoor applications, LEDs operate significantly more efficiently than their incandescent or fluorescent counterparts. At the temperature drops, the efficiency of a typical LED increases, while the efficiency of a comparable fluorescent light decreases.

In keeping with the trend toward LEDs, there is a desire to retrofit existing cinema poster display signs, many of which currently use fluorescent lamps in their interiors, with LED light sources. Such a retrofit is significantly less expensive than a full replacement of the display sign. The LED-based lamps discussed herein are suitable for such a retrofit.

Movie theaters and film distributors in the U.S. have adopted a standard size for the movie posters that are displayed during a film's engagement in the theater. This standard size for the posters in the U.S. is typically known as a "one sheet", which has dimensions of 27 inches wide by 40 inches tall. The display cases that are designed to accommodate the "one sheet" posters may optionally have a small buffer region of an inch or two along the vertical and/or horizontal dimensions, in order to accommodate slight variations in size from poster to poster.

Because the display signs have a standardized size, there is effectively only one variation of cinema display sign in the U.S. It therefore becomes relatively straightforward to envision a single retrofitting module, which can replace the older fluorescent lamps inside these "one sheet" signs.

Other countries have their own standardized sizes, which are generally different from the U.S. "one sheet". It is contemplated that the designs and configurations contemplated in this document may be modified in a straightforward manner to accommodate the poster size in any particular country or region.

For a retrofit, one would first open a cinema sign to gain access to the interior of the sign. One would then remove the fluorescent lamps from the left edge and/or the right edge of the cinema sign. Typically, these lamps are elongated fluorescent tubes with electrical pins at their ends, which couple to respective pairs of so-called "tombstone" connectors. The fluorescent tubes are removed by first pivoting them about their elongated axes until the pins align with a channel in the connector, then pulling them out of the channels at the "tops" of the "tombstones". New tubes are engaged with the tombstone connectors by inserting the pins through the tombstone channels, then pivoting the tubes about their elongated axes.

Once the left and/or the right fluorescent lamp have been removed, one may secure a single LED lamp in a pair of existing tombstone connectors at or near the left edge or the right edge of the cinema sign. Once the LED lamp is secured, one may close the cinema sign, energize the LED lamp through the appropriate tombstone connectors, and operate the cinema sign to inform passers-by about the respective movie on the poster.

In addition to having a relatively high efficiency, a relatively low heat output, and a relatively long lifetime, the retrofit LED lamp also simplifies lamp replacement, since it uses only one set of electrical sockets in the cinema sign, as opposed to using both sets for replacement of the fluorescent lamps.

When mounted and operational, the single LED lamp directs its output largely laterally. For instance, if the LED lamp is mounted on the left side of the sign, then its output is directed largely to the right side of the sign. Similarly, if the LED lamp is mounted on the right side of the sign, then its output is directed largely to the left side of the sign.

In addition to the lateral component, the output may be biased to direct more light toward the front of the sign and less light to the rear of the sign. This bias may result from some asymmetry in one or more of the optical elements in the LED lamp. In addition, in order to ensure that light from the LED lamp is biased toward the front of the sign and not the rear of the sign, it may be desirable to put one or more indicia on the lamp, such as an arrow, indicating where the front of the sign should be located when the LED lamp is installed.

In all of the configurations, light leaving the LED lamp at an angle truly parallel to the front face of the display case (along the Z-direction) misses the front face of the display case completely, and may be partially wasted when it strikes a lateral edge of the display case. As a result, all of the LED lamp configurations discussed herein have angular outputs that reduce propagation along the Z-axis by as much as is practical. For a typical design, about 80% of the LED lamp output strikes the front and rear faces, while only about 20% misses the front and rear faces. In the specific example discussed in detail below, the LED lamp light output is divided asymmetrically between front and rear, with more light being directed to the front face than to the rear face.

Following a discussion of the geometry involved with a typical movie poster display case, an example configuration for the LED lamp is discussed, along with a simulated intensity pattern.

FIG. 1 is a perspective drawing of a movie poster display case 10. The case 10 has a display area 11, in which a movie poster may be displayed. The case 10 may optionally include additional regions on its front face that can include additional information, such as show times, or announcements such as "Now Playing" or "Coming Soon". These additional regions may also use additional light sources; for the purposes of this document, we are primarily concerned with the display area 11.

FIG. 1 shows a set of coordinates for the display case 10. The X-direction is referred to as "vertical", with "up" and "down" being along the +X and −X directions. The Y-direction is referred to as "forward", with "in front of" and "behind" being along the +Y and −Y directions. The Z-direction is referred to as "lateral", with "right" and "left" being along the +Z and −Z directions. These coordinates are used consistently throughout this document.

Although the coordinates (X, Y, and Z) and their accompanying descriptions of (vertical, forward, and lateral) describe orientations of the lamp and its elements when installed, they may also be used to describe orientations when the lamp is uninstalled. For instance, FIG. 1 shows lamps 13 installed in a display case 10. As installed, the lamps 13 are described as being elongated in the vertical (X) direction. When not installed, the lamps 13 may be moved around and positioned in any desired manner, but it remains convenient to describe their direction of elongation as being vertical (X), since this is the case when the lamps 13 are installed. It is understood that the designation of any one axis as the "vertical" axis is arbitrary, and is simply a matter of convenience.

The display case 10 is intended to be non-removably mounted on the wall of a movie theater, with a front face that can be opened to access the interior of the case 10 as needed. The interior may be accessed to change the movie poster, change the movie show times if listed on the case 10, replace a lamp, and so forth. Typically, the front face 12 is hinged along its left side and pivots outward, although the front face 12 may be attached in some other suitable manner. The case 10 has a mechanism for holding a poster against the front face 12, which may include clips to force the posted against a rear side of the front face 12, or a transparent backing surface that forms a pocket in which the poster can rest.

In the case of FIG. 1, the display area 11 is illuminated from two known fluorescent lamps 13, with each lamp 13 located along a respective lateral edge of the case 10, and extending at least partially along the length of the lateral edge of the case 10. It is intended that both fluorescent lamps 13 be removed, and that a single retrofit LED lamp be inserted into the electrical sockets for one of the fluorescent lamps 13. In this manner, a theater owner may keep the existing display case, but may upgrade the lighting within the case. The LED lamp is shown and discussed in greater detail below.

Figure 2:
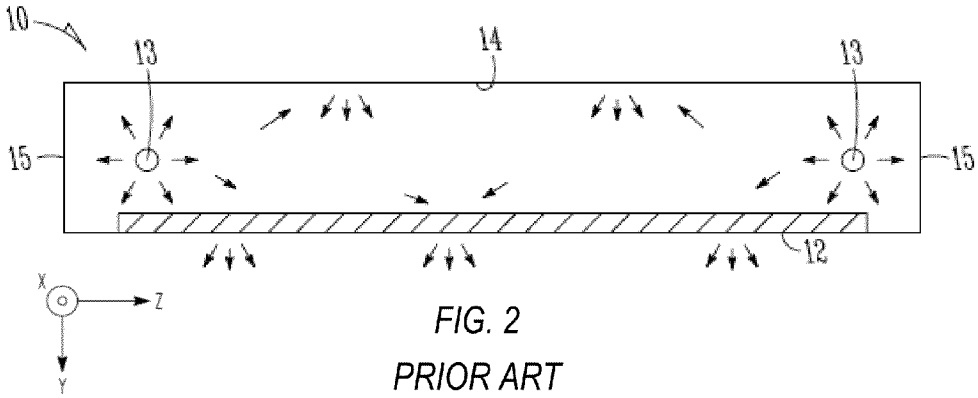
FIG. 2 PRIOR ART
FIG. 2 is a top-view schematic drawing of the display case of FIG. 1, with the fluorescent lamps still present.

FIG. 2 is a top-view schematic drawing of the display case 10 of FIG. 1, with the fluorescent lamps 13 still present. The two fluorescent lamps 13 are disposed behind the front face 12, at or near the lateral edges of the poster. Light from the fluorescent lamps 13 exits the lamps generally uniformly in all directions. Some light strikes the front face 12 and the poster directly, and exits the display case 10 as useable light that may be viewed by a viewer. Some light strikes the rear face 14 of the display case 10, which is diffusely reflective, and is scattered in angle within the interior of the display case 10. Some light strikes the lateral (left and right) faces 15 of the display case, which may be reflective but typically absorb some of the light.

Figure 3:
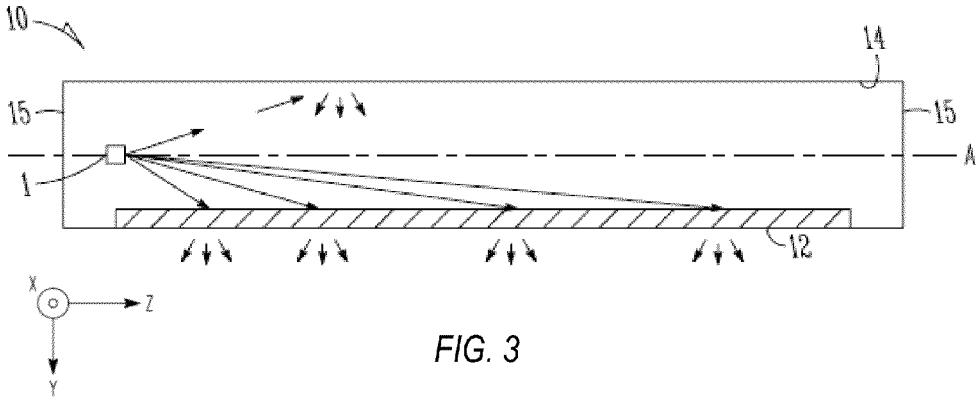
FIG. 3 is a top-view schematic drawing of the display case of FIG. 1, with the fluorescent lamps removed and replaced by a single LED lamp.

FIG. 3 is a top-view schematic drawing of the display case 10 of FIG. 1, with the fluorescent lamps 13 removed and replaced by a single LED lamp 1. It is intended that the LED lamp 1 be retrofit to use the existing electrical sockets that supplied power to the fluorescent lamps 13, so that no additional mounting hardware may be required.

For convenience, a longitudinal axis A is established, for each LED in the LED lamp. In practice, these longitudinal axes are all generally coplanar, so that in the top-down view of FIG. 3, all the longitudinal axes lie on top of each other, and are represented collectively by the notation of A.

For the remaining figures and discussion, it is assumed that the LED lamp 1 is installed in the leftmost set of electrical sockets in the case 10. It is understood that the LED lamp 1 may alternatively be installed in the rightmost set of electrical sockets in the case 10, where the suitable geometry may be reversed left-to-right from the geometry shown in the figures.

For the purposes of terminology, the term "proximal" is used to denote elements that are relatively close to the LED lamp 1, while "distal" is used to denote elements that are relatively far away from the LED lamp 1. In FIG. 3, the leftmost portion of the front face 12 may be referred to as a proximal region of the front face 12 of the case 10. Similarly, the rightmost portion of the front face 12 in FIG. 3 may be referred to as a distal region of the front face 12 of the case 10.

The front 12 and rear 14 faces of the case 10 are shown in FIG. 3 as being diffusive, where light at a single incident angle is transmitted or reflected into a range of exiting angles. For the front face 12, the diffusive properties are generally included with the poster itself, since the poster is printed on slightly diffusive material. The actual front face 12 of the case 10 is clear and is free from diffusive properties.

Figure 4:
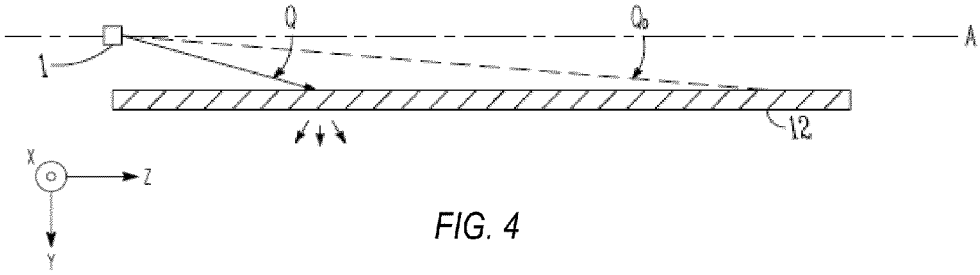
FIG. 4 is a top-view schematic drawing of some angular variables that describe the geometry of the LED lamp in the display case.

FIG. 4 is a top-view schematic drawing of some angular variables that describe the geometry of the LED lamp 1 in the display case 10. The angle Q describes the angular output from the LED lamp, in that intensity from the LED lamp 1 may be predicted and/or measured as a function of propagation angle Q. An angle Q of zero coincides with the lateral axis (Z). A positive value of Q is directed toward the front face 12 of the case 10 and toward the poster. A negative value of Q is directed toward the reflective rear face 14 of the case 10.

A particular angular value $Q_0$ describes the angle formed by a ray that extends from the LED lamp 1 to the distalmost lateral edge of the front face 12. This distalmost lateral edge of the front face 12 is intended to represent the location farthest away from the LED lamp 1 at which illumination is required or desired. In other words, the poster generally extends laterally only as far as this distalmost lateral edge, so that light is provided to the front face 12 only to this edge. Any illumination delivered beyond this distalmost lateral edge, corresponding to propagation angles between zero and $Q_0$, may be considered wasted, and may be reduced by as much as is practical at the design phase of the LED lamp 1.

Figure 5:
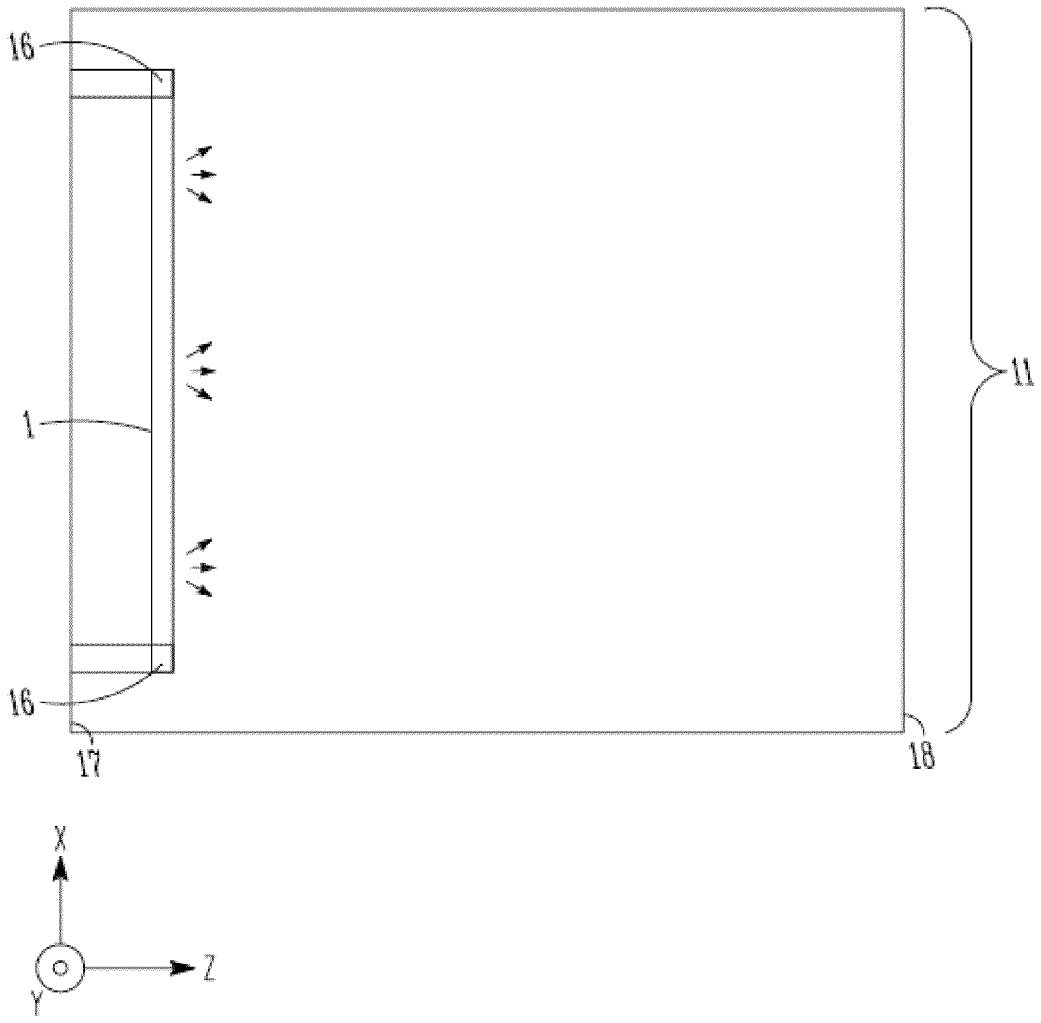
FIG. 5 is a front-view schematic drawing of the display area of the display case.

FIG. 5 is a front-view schematic drawing of the display area 11 of the display case 10, looking through the front face 12 as if observing a displayed poster in the case 10. In FIG. 5, the fluorescent lamps 13 have been removed and replaced by a single LED lamp 1. The lamp 1 may be installed using the same electrical sockets 16 that were used for the fluorescent lamps. It is intended that the existing electrical sockets 16 may mechanically support the lamp 1, and may also electrically power the LEDs in the lamp 1. In this respect, it is intended that the lamp 1 may be truly a retrofit item, which may not require any additional mechanical hardware, or any mechanical or electrical modifications to the display case 10. In addition, it is intended that the LED lamp 1 fit into the same footprint or volume envelope as the fluorescent lamp 13 that it replaces.

The LED lamp 1 may be installed along either lateral edge of the display case 10. In FIG. 5, the LED lamp 1 has been installed at the left edge 17 of the case 10, although the LED lamp 1 may alternatively be installed at the right edge 18 of the case 10. In general, because the lamp emission pattern may be asymmetric, it may be desirable to ensure that the lamp 1 is not installed upside down. Such an installation may result in more light being directed to the rear face 14 of the display case 10 and less light being directed to the front face 12 and the poster.

Figure 6:
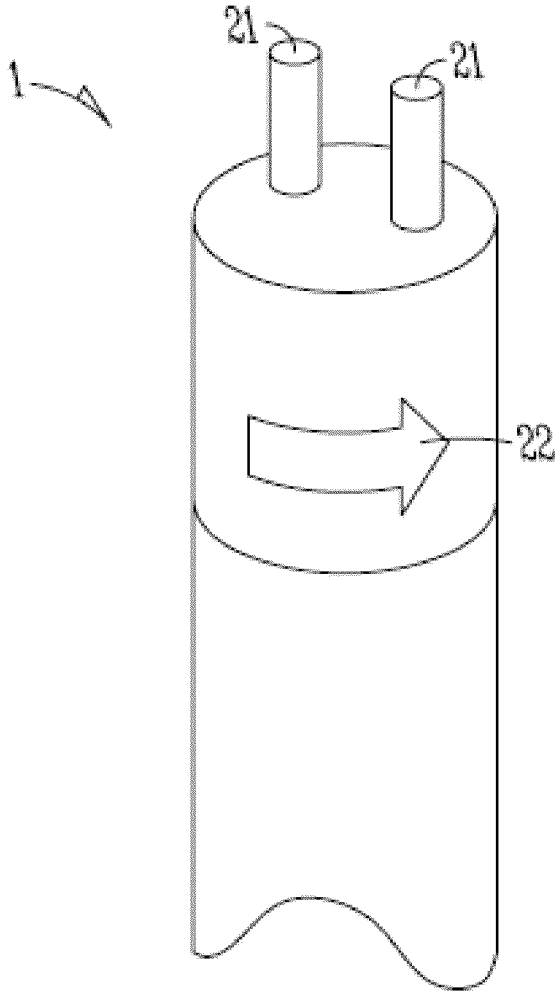
FIG. 6 is a perspective drawing of an example set of pins that extend from the lamp.

In order to prevent such upside-down installation, it may be useful to have one or more identifying marks or indicia on the lamp 1 to identify a desired orientation of the lamp 1. FIG. 6 is a schematic drawing of one end of the LED lamp 1, which shows an example of an identifying mark 22. In this example, the identifying mark 22 is an arrow, which may indicate a front of the display when installed properly. There are many other suitable indicia that can visually indicate to a user which end of the lamp 1 should be installed in which socket 16, all of which should be known to one of ordinary skill in the art. As an alternative, there may also be a locking mechanism, such as a clip or a ridge, which may serve the same purpose as the indicia or identifying mark 22 in preventing upside-down installation of the lamp 1.

FIG. 6 also shows an example set of pins 21 that extend from the lamp 1, and can couple with the socket 16. In general, it is intended that the pin configuration of the LED lamp 1 match the pin configuration used on the fluorescent lamps. Such a pin configuration will be relatively standardized, and will be readily known to one of ordinary skill in the art.

In the preceding paragraphs, it is assumed that the LED lamp 1 is a direct replacement for one of the fluorescent lamps 13, and uses the same electrical and mechanical connections as the fluorescent lamp 13. As an alternative, the ballast and electrical sockets for the fluorescent lamps may also be removed, and one or more new mounting brackets may be installed for the replacement LED lamp 1. The LED lamp 1 may use a ballast that is built into the lamp 1, or may use an external ballast that is installed along with the new mounting bracket in the display case. In all cases, it is assumed that the fluorescent or incandescent system that is removed uses two or more fluorescent or incandescent lamps, and that the LED system that is installed uses only a single LED lamp 1.

The lamp 1 may include an optional cylindrical housing that can protect the optical elements of the lamp from damage and contamination. Alternatively, the housing may expose all or part of a heat sink, which may be used to dissipate heat generated by the LEDs in the lamp 1. It is assumed that a suitable housing configuration is used, and that such a housing will be known to one of ordinary skill in the art.

Whereas FIGS. 1-6 and the accompanying text have presented the LED lamp 1 in general terms, FIGS. 7-10 and the text below present an example configuration for the LED lamp 1. It is understood that other suitable configurations may also be used.

Figure 7:
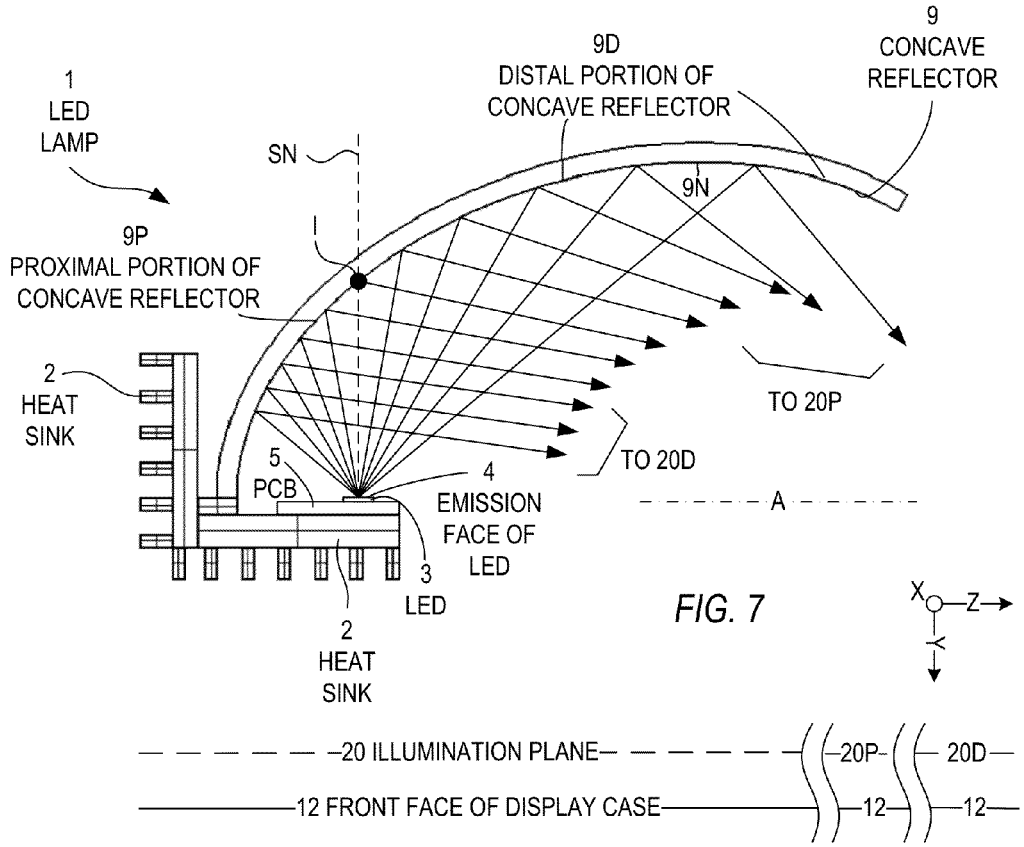
FIG. 7 is a top-view schematic drawing of an example LED lamp.

FIG. 7 is a top-view drawing of the optical components of example LED lamp 1, looking down into the top of the display case 10 as in FIG. 4. In particular, where the LED lamp 1 is elongated and shaped to match the fluorescent tubes that it replaces, FIG. 7 is a cross-sectional view. Specifically, the actual LED lamp 1 includes several LEDs, but only one LED is shown in the cross-section of FIG. 7; the other LEDs in FIG. 7 would be located out of the plane of the page, toward the viewer and/or away from the viewer.

A heat sink 2 is elongated along the vertical (X) direction. Most or all of the additional elements may be attached to or are integral with the heat sink 2. In general, the heat sink 2 dissipates heat produced by the LEDs, mechanically supports a printed circuit board (PCB) 5 that includes the LEDs and associated circuitry, and may have a reflective portion made integral with or attached to the heat sink 2.

The printed circuit board 5 includes a series of LEDs 3 that are also distributed along the vertical (X) direction. In some cases the LEDs 3 are evenly distributed. The LEDs 3 emit white light, typically by producing blue or violet light and including a phosphor that absorbs the blue or violet light and emits light in the yellow portion of the spectrum. The combination of the blue or violet source light with the yellow phosphor-emitted light appears white to the human eye.

The LEDs 3 are attached via the printed circuit board 5 to the heat sink 2, and are physically arranged so that their emission faces 4 face away from the front face 12 of the display case 10. Each LED 3 typically has a generally square emission face 4, and emits light into an angular distribution that is centered around a surface normal (SN).

The surface normals (SN) of all the LEDs 3 are parallel to each other and are generally parallel to the forward axis (Y). The angular distribution is typically Lambertian, with an intensity that peaks along the surface normal (SN), and falls to zero at ninety degrees from the surface normal (SN).

In the particular example of FIG. 7, the surface normals (SN) are aligned with the forward axis (Y) so that they face directly away from the front face 12 of the display case 10, and face directly toward the rear face 14 of the display case 10. As an alternative, the surface normals (SN) may be misaligned with respect to the forward axis (Y). For instance, the surface normals (SN) may be angled toward or away from the lateral axis (Z), and/or may be angled toward or away from the vertical axis (X).

Light from the LEDs initially travels generally upwards in FIG. 7, or toward the rear face 14 of the display case 10, in an angular distribution centered around the surface normal (SN). The light then reflects off a concave reflector 9 back toward the front face 12 of the of the display case 10. For this configuration, the LEDs 4 are disposed between the concave reflector 9 and the front face 12 of the display case 10.

The concave reflector 9 may be either made integral with or attached to the heat sink 2. It is intended that the concave reflector 9 be a specular reflector, rather than a diffuse reflector, so that the angle of reflectance, with respect to a local surface normal, equals the angle of incidence.

The shape of the concave reflector 9 is most easily described in a piecewise manner. The description uses the convention of proximal to signify being relatively close to the LEDs 3 and distal to signify being relatively far from the LEDs 3.

At its proximal end, the concave reflector 9 may be laterally adjacent to the LEDs 3, and may be generally parallel to the surface normal SN to the active area 4. A tangent to the concave reflector 9 at its proximal end may be generally parallel to the surface normal SN of the LEDs 3. Beyond its proximal end, the concave reflector 9 may curve smoothly, without any corners, kinks or discontinuities. The concave reflector 9 may remain concave along most or all of its length.

The concave reflector 9 has generally the same cross-section along its length. As a result, the surface normals SN for the LED active areas 4 may intersect with the concave reflector 9 along a line I. Although I appears to be a point in FIG. 7, I is actually a line that extends out of the plane of the page.

The concave reflector 9 is elongated and extends from a proximal portion 9P near the LEDs 3, through the line I of intersection with the surface normals SN, to a distal portion 9D away from the LEDs 3. The proximal portion 9P and the distal portion 9D of the concave reflector 9 are on opposite sides of the intersection line I. The distal portion 9D of the concave reflector 9 can include a region 9N that is normal to the surface normal (SN). The concave reflector 9 may have a proximal end that is disposed laterally adjacent to the LEDs 3.

The concave reflector 9 reflects light emitted from the LEDs 3 onto an illumination plane 20. When the LED lamp 1 is installed in the display case 10, the illumination plane 20 is located at or near the front face 12 of the display case 10, which is at or near the poster on display. The illumination plane 20 is disposed on an opposite side of the LEDs 3 from the intersection line I. In some cases, the illumination plane 20 is perpendicular to the surface normal SN of the LEDs 3. In other cases, the illumination plane 20 may be at an orientation other than perpendicular to the surface normal SN of the LEDs 3.

The concave reflector 9 is shaped and located so that light striking a particular region of the concave reflector 9 is reflected toward a corresponding region of the illumination plane 20. For convenience, the illumination plane 20 can be described as having a proximal portion 20P near the LEDs 3, and a distal portion 20D away from the LEDs 3. Light reflected from the LEDs 3 off the proximal portion 9P of the concave reflector 9 is directed to the distal portion 20D of the illumination plane 20. Light reflected from the LEDs 3 off the distal portion 9D of the concave reflector 9 is directed to the proximal portion 20P of the illumination plane 20.

Figure 8:
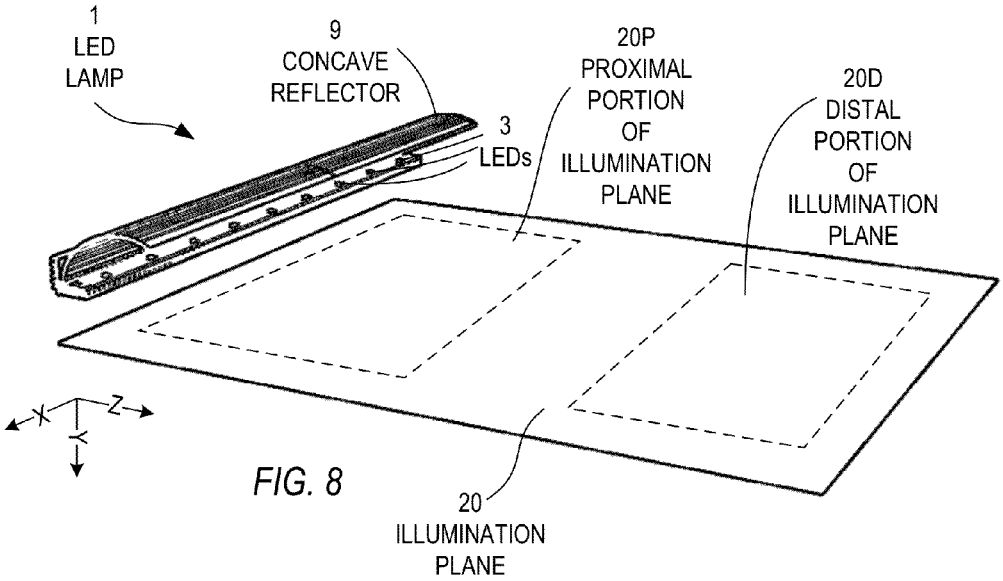
FIG. 8 is a perspective drawing of the LED lamp of FIG. 7.

FIG. 8 is a perspective view of the proximal 20P and distal 20D portions of the illumination plane 20, with respect to the LED lamp 1. The proximal 20P and distal 20D portions of the illumination plane 20 can extend partially or fully to lateral edges of the illumination plane 20, can extend partially or fully toward each other, and can have sharp or rounded edges.

An optical path can extend from the LEDs 3 to the concave reflector 9 to the illumination plane 20. The optical path is devoid of a refractive element, such as a refractive lens, a Fresnel lens, or other optical element that alters the collimation of a beam transmitted therethrough.

Figure 9:
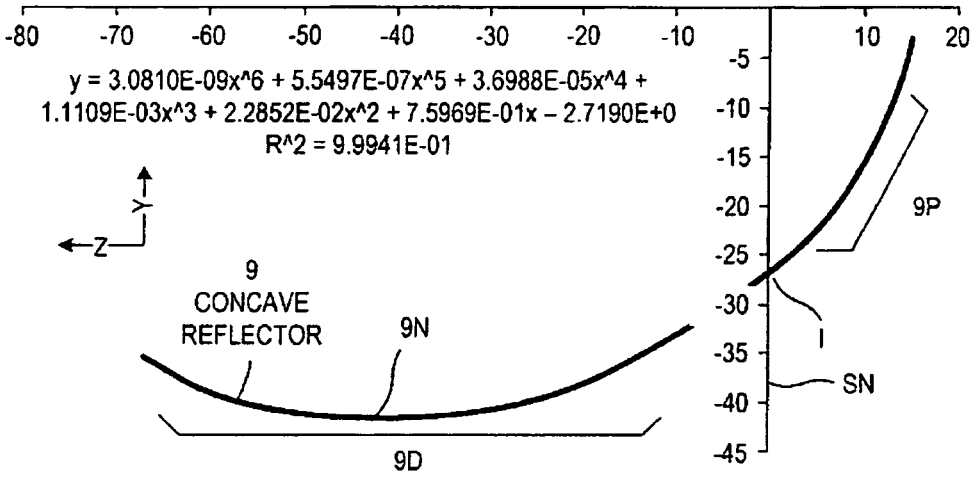
FIG. 9 is a top-view drawing of an example concave reflector.

FIG. 9 shows a top view of an example of a specific shape and location for the reflective surface of the concave reflector 9. Other suitable shapes and locations may also be used. In FIG. 9, the vertical axis is the +Y direction. The grid lines along the vertical axis are spaced apart by 5 mm. In FIG. 9, the horizontal axis is the −Z direction. The tick marks along the horizontal axis are spaced apart by 10 mm. The concave reflector 9 of FIG. 9 receives light from an LED having an active area centered at (y,z)=(0,0) and emitting light downward (in −Y). The concave reflector 9 reflects the LED-emitted light upward (+Y) in FIG. 9 and toward the left (+Z).

In the example of FIG. 9, the most proximal portion of the concave reflector 9 is about 15 mm lateral to the center of the LED. The concave reflector 9 extends distally away from the most proximal portion, curving toward a surface normal (SN) to the LED. The surface normal (SN) would intersect the concave reflector 9 at a distance of 27 mm away from the LED. The concave reflector 9 would continue curving to a region 9N at which it is perpendicular to the surface normal (SN), which is located about 42 mm in front of the LED (i.e., as measured along the surface normal), and 42 mm laterally off to a side of the LED. The concave reflector 9 continues curving beyond region 9N, to a distalmost point about 35 mm in front of the LED and about 67 mm laterally off to the side of the LED. The illumination plane (not shown) is 50 mm behind the plane of the LED. The example concave reflector 9 of FIG. 9 has a surface prescription given by the following polynomial formula: $y(x)=3.0810e\text{-}09x^6+5.5497e\text{-}07x^5+3.6988e\text{-}05x^4+1.1109e\text{-}3x^3+2.2852e\text{-}2x^2+7.5969e\text{-}01x-2.7190e+01$. Such a prescription can be entered into a suitable computer modeling program to simulate performance of the LED lamp.

Figure 10:
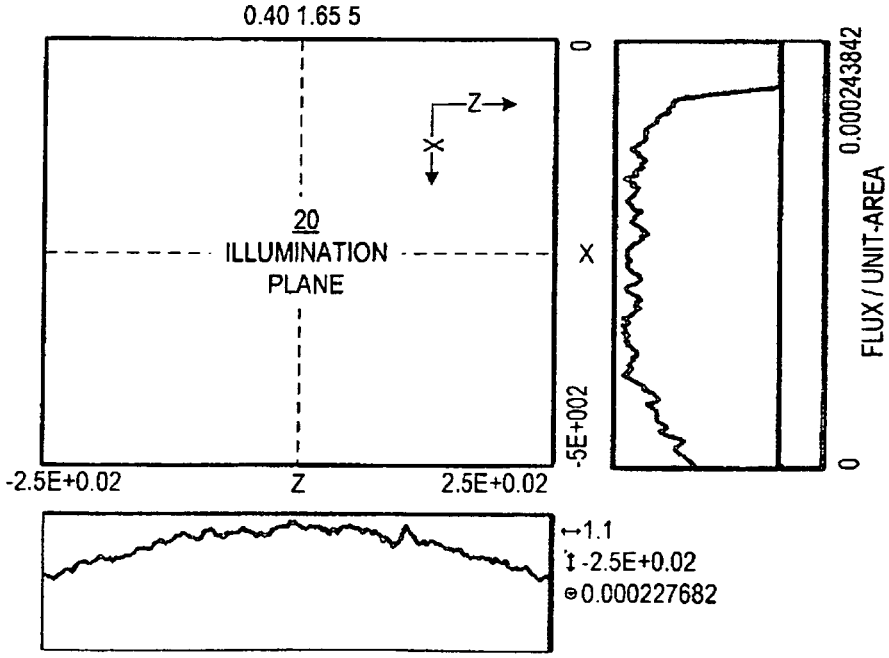
FIG. 10 is a plot of the calculated performance of an LED lamp using the concave reflector of FIG. 9.

FIG. 10 is a plot of the calculated performance of an LED lamp using the concave reflector 9 of FIG. 9. The illumination plane 20 is located 50 mm behind the plane of the LED, and is square with a lateral dimension of 500 mm on a side. The flux per unit area is calculated for two cross-sectional slices through the center of the illumination plane 20. The plot at the right side of FIG. 10 is for a vertical slice, taken along the X direction. The plot at the bottom of FIG. 10 is for a horizontal slice, taken along the Z direction. Both plots show relatively flat flux per unit area in all but the periphery of the illumination plane 20. The plots in FIG. 10 are on a linear scale; in practice, a logarithmic scale corresponds more closely to the performance of the human eye. The curves of FIG. 10 appear even flatter with a logarithmic scale.

Although one lamp can provide illumination for a full display case, there may be instances when multiple lamps can be used. For instance, the display case may be oversized or may require extra illumination. As another example, it may be easier to dissipate the heat generated from the LEDs if the total number of LEDs were split between two lamps. For these cases, two lamps may be formed as described above, and may be located along opposing or adjacent edges of the display case. Alternatively, more than two lamps may also be used.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

GLOSSARY

A Non-Limiting Summary of Above Reference Numerals

1 LED lamp
2 heat sink
3 LEDs
4 emission faces of LEDs
5 printed circuit board
9 concave reflector
9D distal portion of concave reflector
9N portion of concave reflector orthogonal to surface normal of LED
9P proximal portion of concave reflector
10 movie poster display case
11 display area of display case
12 front face of display case
13 fluorescent lamps
14 rear face of display case
15 lateral faces of display case
16 electrical sockets
17 left edge of display case
18 right edge of display case
20 illumination plane
20D distal portion of illumination plane
20P proximal portion of illumination plane
21 pins
22 identifying mark
A longitudinal axis
I intersection line of surface normals with concave reflector
SN surface normal of LED emission face
Q propagation angle of LED lamp light output
X vertical direction
Y forward direction
Z lateral direction

What is claimed is:

1. A replacement lamp (1) for a display case, the display case having an illumination plane (20) at which viewable objects are placeable, comprising:

a plurality of LEDs (3) spaced in a linear array, each LED (3) having a surface normal (SN) and emitting light into an angular distribution centered around the respective surface normal (SN), the surface normals (SN) all being generally parallel;

an elongated concave reflector (9) that reflects light emitted from the LEDs (3) onto the illumination plane (20), the concave reflector (9) intersecting with the surface normals (SN) along an intersection line (I), the concave reflector (9) extending from a proximal portion (9P) near the LEDs (3) to a distal portion (9D) away from the LEDs (3), the proximal and distal portions (9P, 9D) being on opposite sides of the intersection line (I);

wherein the illumination plane (20) is disposed on an opposite side of the LEDs (3) from the intersection line (I);

wherein the illumination plane (20) has a proximal portion (20P) near the LEDs (3) and a distal portion (20D) away from the LEDs (3);

wherein light reflected from the LEDs (3) off the proximal portion (9P) of the concave reflector (9) is directed to the distal portion (20D) of the illumination plane (20); and wherein light reflected from the LEDs (3) off the distal portion (9D) of the concave reflector (9) is directed to the proximal portion (20P) of the illumination plane (20).

2. The replacement lamp (1) of claim 1, wherein a cross-section of the concave reflector (9), taken perpendicular to the intersection line (I), is smoothly curved along its length.

3. The replacement lamp (1) of claim 1, wherein a cross-section of the concave reflector (9), taken perpendicular to the intersection line (I), is uniform for locations along the intersection line (I).

4. The replacement lamp (1) of claim 1, wherein the distal portion (9D) of the concave reflector (9) includes at least one location (9N) at which the concave reflector (9) is perpendicular to the surface normals (SN) of the LEDs (3).

5. The replacement lamp (1) of claim 1, wherein a proximal end of the concave reflector (9) is disposed laterally adjacent to the LEDs (3); and wherein a tangent to the concave reflector (9) at its proximal end is generally parallel to the surface normals (SN) of the LEDs (3).

6. The replacement lamp (1) of claim 1, wherein the surface normals (SN) of the LEDs (3) are perpendicular to the illumination plane (20).

7. The replacement lamp (1) of claim 1, further comprising a plurality of pins (21) that mechanically support the concave reflector (9) and electrically power the plurality of spaced LEDs (3), the pins (21) being configured to couple with a pair of electrical sockets in a display case, the electrical sockets being configured to mechanically support and electrically power a fluorescent lamp.

8. The replacement lamp (1) of claim 1, further comprising a heat sink (2) mechanically coupled to the LEDs (3).

9. The replacement lamp (1) of claim 8, wherein the concave reflector (9) is formed integrally with the heat sink (2).

10. The replacement lamp (1) of claim 8, further comprising a plurality of pins (21) that mechanically support the heat sink (2) and electrically power the LEDs (3).

11. The replacement lamp (1) of claim 8, wherein the pins (21) are configured to couple into a plurality of connectors in a display case, the connectors being configured to mechanically support and electrically power a fluorescent lamp.

12. The replacement lamp (1) of claim 8, further comprising at least one identifying mark (22) that identifies a proper orientation of the lamp (1).

13. The replacement lamp (1) of claim 1, further comprising:

a display case (10) having an interior bounded by a front face (12) in register with said illumination plane (20), a rear face (14) and at least one lateral face (15), the front face (12) receiving light from the concave reflector (9); and at least one electrical socket (16) disposed in the interior of the display case (10), the at least one electrical socket (16) mechanically supporting the heat sink (2) and electrically powering the LEDs (3).

14. The replacement lamp (1) of claim 1, wherein the LEDs (3) are white-light LEDs; and wherein the concave reflector (9) is devoid of wavelength conversion material.

15. The replacement lamp (1) of claim 1, wherein an optical path, from the LEDs (3) to the concave reflector (9) to the illumination plane (20), is devoid of a refractive element.

* * * * *